United States Patent [19]

Motani et al.

[11] 4,101,395

[45] Jul. 18, 1978

[54] CATHODE-STRUCTURE FOR ELECTROLYSIS

[75] Inventors: Kensuke Motani; Toshikatsu Sata; Masakatsu Nishimura, all of Tokuyama, Japan

[73] Assignee: Tokuyama Soda Kabushiki Kaisha, Japan

[21] Appl. No.: 718,769

[22] Filed: Aug. 30, 1976

[51] Int. Cl.[2] ..... C25B 1/46; C25B 11/03; C25B 13/08

[52] U.S. Cl. ..... 204/98; 204/252; 204/283; 204/290 R; 204/296

[58] Field of Search ..... 204/282–283, 204/290 R, 98, 252, 296

[56] References Cited

U.S. PATENT DOCUMENTS

| | | | |
|---|---|---|---|
| 3,427,234 | 2/1969 | Guthke et al. | 204/283 X |
| 3,689,315 | 9/1972 | Quentin et al. | 204/290 R X |
| 3,873,437 | 3/1975 | Pulver | 204/282 X |

FOREIGN PATENT DOCUMENTS

| | | | |
|---|---|---|---|
| 811,128 | 4/1969 | Canada | 204/283 |

*Primary Examiner*—G. L. Kaplan
*Assistant Examiner*—D. R. Valentine
*Attorney, Agent, or Firm*—Sherman & Shalloway

[57] ABSTRACT

A cathode-structure for liquid-phase electrolysis comprises a cathode and a polymer containing a cation exchange group, with the polymer being laminated in the form of a film on one surface of the cathode.

9 Claims, No Drawings

CATHODE-STRUCTURE FOR ELECTROLYSIS

This invention relates to a cathode-structure for electrolysis. Commercial production of alkali metal hydroxide, halogen gas or oxygen and hydrogen by electrolysis of aqueous solutions of alkali metal salts, especially an aqueous solution of sodium chloride, has previously relied both on a mercury method and a diaphragm method. Because of the consequent pollution by mercury, however, the mercury-method electrolysis has recently tended to go out of operation, and to be superseded by the diaphragm method. Water-permeable neutral diaphragms made of asbestos are generally used in the diaphragm-method electrolysis, and various suggestions of the diaphragm-method electrolysis have been made in recent years in which to use porous neutral diaphragms composed of fluorine-containing polymers, or porous diaphragms having cation-exchangeability. The neutral diaphragm means a water-permeable diaphragm having no ion exchange group, and all references to neutral diaphragms in the following description are those to such diaphragms.

The present invention relates to a novel cathode structure in an electrolysis apparatus using ion-exchange membranes that are characterized by affording high purity sodium hydroxide.

It is an object of this invention to support a membrane stably, make it possible to operate an electrolytic cell at low voltages, and to prolong the lifetimes of the membrane and cathode.

The invention is also characterized in that it can be applied to electrodes of wavy and other forms in a finger-type electrolytic cell having curved electrodes and permitting a high output per unit volume of the cell. The invention brings about good results in increasing the current efficiency and the purity of hydrogen generated at the cathode.

The present invention provides a cathode-structure for liquid-phase electrolysis comprising a cathode and a polymer containing a cation exchange group, with the polymer being laminated in the form of a film on one surface of the cathode.

The invention also provides an electrolytic apparatus including the above cathode-structure and a method for electrolysis carried out using the above cathode-structure.

The "lamination of the polymer containing a cation exchange group" means that the polymer is laminated in the form of a film to one surface of the cathode using various techniques such as adhesion, melt-adhesion, polymerization, condensation or curing treatment either directly or indirectly through a suitable medium.

Generally, in conventional electrolytic devices using cation exchange membranes, the cathode is completely separated from the cation exchange membranes. The cation exchange membranes are merely disposed at suitable positions between the anode and the cathode, or are merely placed in juxaposition with the anode or cathode in a parallel relation. Since the cation exchange membranes have shorter lives than the anode and cathode, there has been no concept of laminating them into a unitary structure.

The lamination gives a stable support to the diaphragm. When the cathode and the membrane are merely placed in juxtaposition, a gas stays in the interstices of the network structure or lattice structure that makes up the cathode (the formation of a "gas pocket"), and electric resistance attributable to bubbles of the staying gas and electric resistance by the rising of a part of the gas between the cathode and the membrane cause an increase in voltage. According to the present invention, however, the membrane naturally enters the interstices of the network structure or lattice structure that makes up the cathode, and consequently, no gas pocket occurs. In other words, there is no staying of gas bubbles, but the gas generated easily rises along the back surface of the cathode. As a result, the cell voltage can be decreased by about 150 to 200 mV as compared with the case of mere juxtaposition of the cathode and the membrane. The reduction of the cell voltage directly affects the operating cost, and is exceedingly significant in reducing the cost of production.

The present invention also offers an advantage of prolonging the life of the membrane and the cathode. As a result of lamination, the membrane and the cathode are free from damages which normally occur by friction between them when they are merely juxtaposed to each other. Furthermore, the cathode-structure of the invention is free from the phenomenon that hazardous materials present in the gas pocket adhere to the membrane to reduce its function. When the cathode and the diaphragm are merely placed side by side, slight vibration occurs in the diaphragm during operation, but as a result of lamination, such vibration is prevented. Accordingly, this brings about unexpected superior results in increasing the life of the membrane. Usually, the lamination increases the life of the membrane by about 20 to 30%. The increase of the life of membrane which are expensive is not only economically advantageous, but also significant in that electrolysis can be carried out continuously over prolonged periods of time and the frequency of membrane exchanging operations can be reduced.

Another characteristic feature of the cathode-structure of the invention is that it can be applied to cathodes of any desired shape.

Generally, ion exchange membranes have a defect of lacking flexibility. This defect imposes a great restriction on the building of an electrolytic cell. In general, in diaphragm-method electrolytic cells using asbestos, various improvements have been attempted in order to increase the area of electrodes, and cells using so-called finger type electrodes are in widespread use. This results in an increased amount of current which can be flown per electrolytic cell, and therefore in a markedly increased output per cell. This also offers an advantage of reducing the floor space required.

When it is desired to build a finger-type electrolytic cell using an ion exchange membrane, it is difficult to adhere the ion exchange membrane uniformly to a finger-type cathode because of the lack of the flexibility of the ion exchange membrane or because of the difficulty of adhesion between the membrane and the electrode. Generally, when it is attempted to adhere an ion-exchange membrane in a sheet form intimately to a finger-type cathode, the ion-exchange membrane sometimes breaks or develops pinholes or cracks, thus losing its function as an electrolytic membrane. In other words, ion-exchange membranes fabricated in a flat sheet form are generally effective only when it is used in a flat condition, and it is generally not desirable to use it in a deformed state, for example, in a curved form. Hence, a separate method should be devised in order to place an ion-exchange membrane in intimate adhesion to an electrode not having a planar structure, for example, a finger-type electrode.

The present invention can be easily applied to the formation of a laminated membrane not only on such a finger-type cathode but on other cathodes having any desired shape.

The cathode-structure of this invention is now described in greater detail.

The polymer having a cation exchange group used in this invention may be any of known polymers containing a cation exchange group. Preferred polymer are generally those which contain known cation exchange groups and are feasibly oxidation- and reduction-resistant to gases generated in the anode and cathode compartments. Specific examples of the oxidation-resistant polymers containing a cation exchange group are a sulfonated polymer of $\alpha$, $\beta,\beta$-trifluorostyrene, and a hydrolyzate of a membrane of a copolymer of tetrafluoroethylene and perfluro(3,6-dioxa-4-methyl-7-octenesulfonyl fluoride)

$$CF_2{=}CFOCF_2CF(CF_3)OCF_2\overset{\overset{SO_2F}{|}}{C}F_2.$$

The cation exchange groups may be possessed by the polymer itself, or introduced into the polymer before or after the lamination.

Corrosion-resistance cathodes known heretofore to be usable in electrolysis of an aqueous solution of an alkali metal salt can be used in the present invention. Generally, iron, nickel, various types of stainless steel, and iron or mild steel coated with nickel, cobalt, chromium, manganese, etc. (particularly, nickel), for example, can be used with good results as materials for the electrodes. The shape of the cathode is not at all limited, but any desired shape, such as a network, lattice, porous sheet, rod, cylinder or wickerwork can be used.

That surface of the cathode to which the polymer having a cation exchange group is to be laminated in film form is preferably inactivated beforehand to substantially avoid electrolysis. The inactivating treatment can be carried out by coating the surface with a resin, or a paint, for example. Or that surface of the cathode to which the polymeric film is not laminated may be activated with, for example, a nickel coating so as to render the opposite surface inactive relatively. If the inactivating treatment is performed, the separation of the polymeric film from the cathode can be prevented.

The greatest feature of the present invention is that the polymer having a cation exchange group is laminated in the form of a film on one surface of the cathode. As previously stated, the term "lamination of the polymer containing a cation exchange group" means that the polymer is laminated in the form of a film to one surface of the cathode using various techniques such as adhesion, melt-adhesion, polymerization, condensation or curing treatment either directly or indirectly through a suitable medium.

In laminating the polymer onto the cathode, any method which ensures the firm adhesion of the polymeric film to the surface of the cathode can be used. Examples include a method which comprises polymerizing or condensing monomers containing a polymerizable or condensable functional group or a monomeric composition consisting of the monomer, a plasticizer, a backing material, a soluble polymer, etc. on the surface of a cathode to form a polymeric film on the cathode surface; a method which comprises adhering a powdery polymer to the surface of a cathode by, for example, electrostatic attraction, and melting it into a film and fixing it to the surface of the cathode; a method which comprises mixing a powdery polymer having an ion exchange group or an inorganic ion exchanger with a tacky binder, coating the mixture on the surface of a cathode, and cementing the mixture to the cathode surface utilizing a solidifying action of the binder; a method which comprises dissolving a polymer in a solvent, coating the solution on the surface of a cathode, and removing the solvent to form a film and adhere it to the cathode; a method which comprises melting a polymer, coating it in the form of a film onto the surface of a cathode, and solidifying it by cooling thereby to adhere it to the cathode surface; and a method which comprises coating a polymeric composition composed mainly of a liquid or plastic polymer on the surface of a cathode, and subjecting the coating to a crosslinking treatment to harden it and adhere it to the cathode surface. Preferred embodiments can be achieved by a method which comprises forming an organic or inorganic substance into a film form on the surface of a cathode and at the same time fixing it to the cathode.

Electrolytic cathode-structures in which a polymer containing a cation exchange group is laminated in film form are quite novel in the technical field to which the invention pertains and in which large quantities of bases and other substances are generated by the electrolysis of aqueous solutions of alkali metal salts, for example.

It has previously been suggested to use a wire gauze as a reinforcing material for ion exchange resin membranes. But this merely serves to retain the mechanical strength of the membranes. The wire gauze is present within the resin membrane, and is not intended for electrode reaction.

Some specific examples of the laminating technique are given below.

(1)

In order to laminate a heterogeneous cation exchange membrane onto the surface of a cathode, a fine powder of a polymerized or condensed cation exchange resin or an inorganic ion exchanger is uniformly mixed with a suitable thermoplastic polymer, and the mixture is adhered to a metal as a cathode (sometimes referred to simply as an electrode). Alternatively, the fine powder of ion exchange resin is uniformly dispersed in a viscous solution of a linear polymer, and the dispersion is adhered uniformly to the electrode by coating, dipping, or spraying, etc., followed by evaporating off the solvent. In still another embodiment, the inorganic ion exchanger is mixed with cement, and the mixture is adhered to the electrode. In this way, the polymer can be laminated on the cathode by utilizing conventional techniques used for the production of heterogeneous ion exchange membranes.

(2) Likewise, uniform cation exchange membranes can be laminated to the cathode by applying various conventional techniques heretofore suggested for the production of homogeneous ion-exchange membranes.

Some specific embodiments are given below.

(a) One embodiment comprises adhering a monomer containing a polymerizable functional group such as vinyl or allyl to the electrode either directly or through a backing placed on the electrode by such means as coating, dipping or spraying, and heating the assembly to polymerize the monomer. Where it is necessary to prevent sagging of the material solution, the viscosity of the material is adjusted according to the shape of the cathode, or it is covered with a suitable film such as Cellophane.

Usable vinyl and allyl monomers are those which have heretofore been known. Specific examples include acrylic acid, methacrylic acid, α-phenylacrylic acid, α-ethylacrylic acid, α-halogenoacrylic acids, maleic acid, itaconic acid, α-butylacrylic acid, vinylbenzoic acids, a monomer resulting from the bonding of a vinyl group and a carboxyl group to the naphthalene ring, styrene, vinyltoluenes, methacrylate esters, acrylate esters, acrylonitrile, vinylpyridines, N-vinylpyrrolidones, vinylimidazoles, butadienes, isoprenes, chloroprenes, vinyl chloride, vinyl acetate, acrolein, methylvinyl ketone, chloromethylstyrenes monochlorostyrenes, polychlorostyrenes, α-fluorostyrene, α,ββ-trifluorostyrene, α-methylstyrene, vinylidene chloride, vinyl fluoride, vinylidene fluoride, chloromethylstyrenes, vinylsulfonic acid and its salts and esters, styrenesulfonic acid and its salts and esters, allylsulfonic acid and its salts and esters, vinylphosphonic acid and its salts and esters, styrenephosphonic acid and its salts and esters, styrenephosphinic acid and its salts and esters, vinylphosphinic acid and its salts and esters, vinylphenols and their salts and esters, tetrafluoroethylene, trifluoroethylene, ethylvinylbenzenes, maleate esters, itaconate esters, and vinyl bromide.

Polyvinyl compounds used as a crosslinking agent include o-, m-, and p-divinylbenzene and their mixtures, divinylpyridines, trivinylbenzenes, divinylnaphthalenes, trivinylphthalenes, isoprene, chloroprene, butadiene, divinylchlorobenzenes, divinylethylbenzenes, bimethallyl, biallyl, divinyl ether, divinyl acetylene, divinyl sulfone, 2,3-diethylbutadiene, and halobutadienes.

Radical polymerization initiators can also be used as desired, and include, for example, benzoyl peroxide, α,α-azoisobutyronitrile, lauryl peroxide, tert-butyl peracetate, tert-butylperbenzoate, 2,5-dimethyl (2,5-dibenzoyl peroxy) hexane, 2,5-dimethyl(2,5-dibenzoyl/-peroxy)hexene-3, p-menthanehydroperoxide, diisopropyl benzenehydroperoxide, αα'-di(tert-butyl peroxy)-diisopropyl benzene, cyclohexanone peroxide, tert-butyl peroxyisopropyl carbonate, 2,5-dimethyl-3-hexane, 2,5-dimethyl-3-hexene, tert-butylperoxy laurate, di-tert-butyl-diperoxyphthalate, 1,1'-di-(tert-butylperoxy)cyclohexane, 1,1'-di-(tert-butylperoxy)3,3,5-trimethylcyclohexane, methylethyl peroxide, methylisobutyl ketone peroxide, tert-butylhydroperoxide, di-tert-amyl peroxide, tert-butylcumyl peroxide, dicumyl peroxide, 2,5-dimethyl-2,5-di(tert-butyl peroxy)-hexane, 2,5-dimethyl-2,5-di(tert-butylperoxy) hexene-3, and initiators having a decomposition temperature of at least 135° C and a half life of at least 10 hours, such as cumene hydroperoxide, 2,5-dimethyl-2,5-dihydroperoxyhexene, and 2,5-dimethyl-2,5-dihydroperoxy hexene-3.

Furthermore, if desired, linear polymers may be dissolved or dispersed in the above mixture. Examples of such polymers are a styrene/butadiene copolymer, polystyrene, a poly(acrylic acid ester), chlorosulfonated polyethylene, polychloroprene, polybutadiene, polyethylene, polypropylene, polyvinyl halides, polyvinylidene halides, polytetrafluoroethylene, polytrifuloroethylene, halogenated polyethylene, chlorosulfonated polypropylene, and halogenated polypropylene.

The above ingredients are suitably mixed with each other to form a viscous composition. The composition is adhered to the electrode by suitable means such as coating, dipping or spraying, and heat-polymerized at elevated pressures or at atmospheric pressure to obtain the structure of this invention. If desired, the structure may be subjected further to sulfonation, hydrolysis or other known means for introduction of cation exchange groups or conversion to cation exchange groups.

(b) A method using a linear polyelectrolyte can also be cited. Generally, it involves dissolving a linear polymer or linear polyelectrolyte containing a cation exchangeable functional group and/or a functional group capable of introducing a cation exchangeable functional group easily, such as polystyrenesulfonic acid or its salts and esters, polyacrylic acid or its salts and esters, or polymethacrylic acid or its salts and esters, in a suitable solvent, adhering the solution to an electrode support, and then driving off the solvent, followed, if desired, by introduction of a crosslinkage and then by introduction or conversion of ion exchange groups. If a vinyl or allyl monomer having appropriate crosslinkability, especially a bifunctional monomer, is added in the polyelectrolyte solution, and subjected to heat-treatment or radiation treatment, it is especially effective for insolubilizing the polymeric electrolyte. There can also be used a method in which an inert soluble polymer and an anionic polyelectrolyte are adhered in solution form and the solvent evaporated off as in the production of an interpolymer membrane, or a method in which the adhered membrane is further subjected to a crosslinking treatment.

Examples of effective methods are a method which comprises dissolving high-molecular-weight poly (sodium acrylate) in water, dissolving high-molecular-weight polyvinyl alcohol in it, fully deaerating the resulting viscous aqueous solution of the polymer, adhering the solution to the electrode by such means as dipping, rapidly drying it so that no bubble is formed, and then subjecting the adhered polymer to a crosslinking treatment using, for example, formaldehyde, glyoxal, crotonaldehyde, or acrolein to make it insoluble, thereby to form the structure of this invention, and a method which comprises dissolving high-molecular-weight polymethacrylic acid and a polyepoxy compound such as diepoxycompounds in an alcohol such as methanol to form a viscous solution, adhering the solution to, for example, a mesh electrode, dipping the assembly in a suitable solvent which does not dissolve the adhered polymer, for example, diamines and polyamines such as meta-phenylenediamine, ethylenediamine or pentaethylenehexamine to react the amine with the epoxy compound to form a three-dimensional structure. In this case, the amine compound is selected from the standpoint of the reactivity of the epoxy compound and the stability of the amine compound in the formation of a three-dimensional structure.

Another effective method comprises heating a linear thermoplastic polyelectrolyte or a thermoplastic polymer which are convertible to a linear polyelectrolyte by a simple means such as hydrolysis and are insoluble in water, salts, or acidic or basic aqueous solutions used, and thus melt-adhering it to the electrode, and if required, introducing an ion exchange group. Expecially preferred linear polymers of this kind are expressed by the following formula

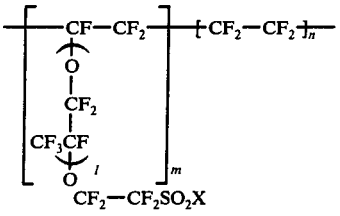

wherein $m$ and $n$ are positive integers, $l$ is O or a positive integer, and X is halogen, —OH or —OR (R is an alkyl group).

(c) There is also a method in which to use an inert polymeric compound. This method involves adhering a thermoplastic polymer, such as polyethylene, polypropylene, polyvinyl fluoride, polyvinylidene fluoride, polytrifluorochloroethylene, polytetrafluoroethylene, a styrene/butadiene rubber, polychloroprene, copolymers of tetrafluoroethylene and perfluoroalkyl vinylethers, polyisoprene, polyvinyl chloride, and polyvinylidene chloride, to a mesh electrode by heat fabrication to form a thin membrane, and introducing an ion exchange group into the membrane by some method. There is no particular restriction on the method of adhering the polymer. Effective methods include, for example, a method which comprises dissolving or dispersing at least one of the polymeric compounds, dipping the electrode in the solution or dispersion, and then driving off the solvent; a method which comprises coating or spraying the solution or dispersion on the electrode, and then driving off the solvent; a method which comprises electrostatically charging a fine powder of the above polymeric compound, charging the electrode to an opposite polarity to adhere the fine powder electrostatically to the electrode, and then heating the fine powder to melt-adhere the polymer thereto in the form of a film; a method which comprises melting the polymer at high temperatures which do not cause its heat decomposition, and dipping a mesh electode, for example, in the molten polymer to adhere it to the electrode; and a method which comprises fabricating the polymer using a mesh electrode as a core. These methods are selected according to the type and properties, such as molecular weight, of the polymers used, and the material, shape and purpose of use of the electrode.

An ion exchange group must be introduced into the polymeric compound adhered. Where the polymer adhered permits the introduction of ion exchange groups, it is treated directly with ion exchange group introducing reagents which do not markedly corrode the material of the electrode.

Alternatively, the polymeric compound adhered is impregnated with a polymerizable vinyl or allyl compound at room temperature or at an elevated temperature, and in the presence of a radical polymerization initiator, it is heated at elevated pressures to polymerize it under conditions which do not dissipate the impregnated compound. In this case, a crosslinkable polyvinyl compound may be caused to be copresent to form a three-dimensional structure. The polymerization means is not limited to radical polymerization, but cationic polymerization, anionic polymerization, and redox polymerization may also be employed. Where it is noticed that too large a quantity of vinyl or allyl compounds is impregnated in the polymer to cause a considerable dimensional change or render its mechanical strength weaker, a suitable solvent is added to the impregnating bath to dilute it and thus reduce the amount of the compound to be impregnated. Where the amount of the vinyl or allyl compound to be impregnated is small, the polymer film adhered may be first swollen with a solvent, and then dipped in the above monomer. The amount of inpregnation can of course be increased by heating.

Instead of the method described above, a vinyl or allyl monomer may be graft-copolymerized with the adhering polymer by ionizing radiation, for example. In this case, ionizing radiation may be carried out on the polymer adhered thereby to form radicals and then the assembly dipped in the monomer or monomeric mixture. Or the adhered polymer may be subjected to ionizing radiation while being dipped in the monomer or monomeric mixture. Alternatively the polymer may be radiated after having been dipped in the monomeric compound. An optimal methods may be chosen among these method according, for example, to the purpose of using the electrode structure, the type of adhered polymer, and the shape and material of the electrode. For example, there can be used a method which comprises melt-adhering a sheet of vinylidene fluoride resin to an electrode by heating, dipping the assembly in acrylic acid or a mixture of acrylic acid with styrene and divinyl benzene, and then graft-copolymerizing the monomer to the vinylidene fluoride polymer sheet by ionizing radiation, or a method which comprises heating polyethylene and melt-adhering it to an electrode, dipping the assembly in a heated solution composed of methacrylic acid, divinylbenzene and benzoyl peroxide to impregnate it thoroughly in the polyethylene, and heat-polymerizing the monomers with the polyethylene at high pressures in an autoclave. Alternatively, styrenesulfonic acid, or its esters or salts, styrenesulfonyl halides or acrylic acid, etc. is graft-copolymerized to a fine powder of polyethylene, etc., and the graft-copolymer is applied to a mesh electrode, and adhered to it by heating. In this case, an ion-exchange group may be introduced, if desired, by such means as hydrolysis.

(d) There can also be used a method in which to use a mold. The method comprises adding a crosslinking agent such as divinylbenzene to acrylic acid, methacrylic acid, a styrenesulfonic acid ester, or a vinylsulfonic acid ester, etc., further adding a radical polymerization initiator, if desired uniformly mixing them with other additives such as a solvent as a diluent, a linear polymer, or a finely divided crosslinked polyner, and pouring the resulting monomeric mixture solution into a mold in which an electrode has been inserted as a core, and heat polymerizing the monomers.

Some examples of producing the electrode structure of this invention have been described hereinabove, but it should be understood that the present invention is in no way limited by the above exemplification. Basically, any structures resulting from the lamination of a cation exchange membrane on an electrode by some method are within the scope of the present invention. For example, it is possible to melt-adhere a membrane containing $—SO_2F$ or $—SO_2Cl$, such as NAFION (a trademark for a product made by E. I. du Pont de Nemours & Co.) to an electrode, and then hydrolyze it to render the group cation-exchangeable, for example, $—SO_3H$. Where a monomer is to be polymerized or copolymerized on an electrode, it is sometimes desirable to cover one or both sides of the electrode with a sheet of flexible polymers, for example, Cellophane, Vinylon, or a fluorine-containing polymer, etc. so as to prevent the monomer from volatilization or being present non-uniformly, and also prevent the occurrence of pinholes, and holes, etc. Furthermore, the polymerization can be performed while rotating the electrode in an autoclave to prevent the unbalanced distribution of the resin components.

Another essential constituent element of the invention is that the polymer containing an ion exchange group is laminated in the form of a film to one surface of the electrode. In other words, one surface of the electrode is covered with the polymer film having cation exchange group, and the other surface is always exposed. This well serves to remove gases generated by electrolysis. In order to perform good electrolysis, that surface of the electrode which is coated with the polymeric film containing a cation exchange group should not contain any fine cracks nor pinholes. Essentially, the polymeric film adhered should have a water-impermeability about the same as that of an ordinary ion-exchange resin membrane. In order to expose one surface of the electrode, the polymer containing a cation exchange group is laminated in the form of a film to only one surface of the electrode. For example, it is effective to cover one surface of the electrode with a material not permeable to the monomers and readily strippable after film formation, such as a sheet of polytetrafluoroethylene (Teflon), cellulose (Cellophane) or polyvinylidene chloride (Saran). However, some of the methods of lamination described above cannot ensure the application of the polymeric film only to one surface of the electrode. In such a case, the film on the other surface is mechanically removed, or where a solvent capable of dissolving the polymeric film is available, the film on the other surface of the electrode may be removed by dissolving with the solvent.

When the electrode structure of this invention is used for electrolysis of alkali metal salts, a thin anion-exchangeable layer or a thin neutral layer may be present at least on one surface or interior of the cation exchange membrane in order to increase the current efficiency of the alkali metal hydroxide formed. It is especially preferred in this case that the thin layer be cross-linked and compact. The presence of the anion exchangeable or neutral thin layer may be obtained by physical or chemical adhesion or adsorption, or by an ionic bond, covalent bond or coordination bond. Alternatively, the cation resin part and the thin layer may be bonded to each other at their interface by the entanglement between the polymer matrix of the membrane and the treating polymeric agent which is formed on the thin layer. Or the thin layer may be present in the form of a layer on the cation exchange resin part; or it may be present also in the surface layer of the cation exchange resin toward its interior as a result of some suitable chemical reaction.

Any known functional groups which yield a negative charge in aqueous solutions may be used in the present invention as the ion exchange groups of the cation exchangeable resin part. They include, for example, a sulfonic acid group, a carboxylic acid group, a phosphoric acid group, a phosphorous acid group, a sulfate ester group, a phosphate ester group, a phosphite ester group, a phenolic hydroxyl group, a thiol group, a boric acid group, a silicic acid group, an acid amide bond having dissociable hydrogen, and a stannic acid group. These ion exchange groups may be present to such as extent that the polymer to be laminated to the cathode in the form of a film functions as an ion exchange membrane.

When the electrode structure of this invention is used for electrolyzing alkali metal salts, the cathode structure may further be treated by various methods in order to increase the current efficiency of the alkali metal hydroxides formed. One of such methods involves forming an anion-exchangeable thin layer uniformly or in layers on the surface of the membrane or in the interior of the membrane. For example, an amino compound containing a primary or secondary amino group is chemically bonded to a membrane of a sulfonyl halide or carboxylic acid halide. Specifically, this procedure comprises bonding a secondary amino such as dipropylamine or diethylamine, a monoalkylamine such as methylamine or laurylamine, or an ethylene polyamine such as ethylenediamine or diethylenetriamine to the halide membrane mentioned above thereby to decrease the number of cation exchange groups such as sulfonic acid or carboxylic acid groups in the surface layer of the membrane or in its interior, or to form a crosslinked structure by an acid amide linkage. Where the resulting thin layer is unstable to oxidizing agents, it is desirable to fluorinate or chlorinate the thin layer by a desired method using, for example, a fluorine or chlorine gas, a fluorinating reagent such as cobalt fluoride, or by electrolyzing fluorination. Most preferably, the amine treatment in this case should be carried out on the cathode-side surface of the membrane to such an extent that the electric resistance of the membrane does not markedly increase. However, in view of the durability of the membrane, it may be carried out in the part ranging from the surface to the interior of the membrane, or in the interior of the membrane in layer form, or on the back surface of the membrane uniformly or with gradient. In these alternative cases, too, the increase of the electric resistance of the membrane should be avoided as much as possible.

The formation of a crosslinkage or the partial inactivation of cation exchange groups by the formation of an ester linkage using a mono- or poly-hydric alcohol is also effective. It is also effective to form a sulfone linkage with an aromatic compound or partially inactivate cation exchange groups. Furthermore, membranes impregnated with polyethylene oxide, polypropylene oxide, a copolymer of ethylene oxide and propylene oxide, or a nonionic surface active agent having these compounds bonded therein, a cationic surface active agent, or an anionic surface active agent, or membranes obtained by rendering the impregnated compounds of the resulting membranes incapable of dissolving out of the membranes are also effective for obtaining alkali metal hydroxides with extremely high current efficiencies.

As described above, when alkali metal hydroxides are to be obtained by using the cathode structure of this invention, various known means used to increase current efficiency in electrolysis with conventional cation exchange membranes can be applied also to the cathode structure of this invention in order to increase its performance.

In order to increase the strength of the polymeric film layer to be formed on the electrode, a woven fabric, a non-woven fabric, staple fibers, or continuous filaments may be present. Desirably, the fibrous materials are composed of, for example, polypropylene, polyethylene, polyvinyl chloride, polyvinyl alcohol, polyvinylidene chloride, glass fibers, polyesters, polyacrylonitrile, and fluorine-containing polymers (e.g., polytetrafluoroethylene).

The cathode-structure for electrolysis according to this invention which is obtained by laminating the polymeric film containing a cation exchange group on one surface of a cathode can be used in any desired mode for electrolysis together with an anode as a pair in a system in which an anolyte solution does not mix with a catholyte solution and selective permeation of cations is required. For example, it is effective for organic electrolytic reactions, or an electrolytic dimerization reaction of acrylnitrle. It can also be utilized for electrolysis of solutions of a wide range of inorganic electrolytes in addition to the electrolysis of alkali metal salts. The cathode-structure of this invention is especially effectively applicable to the electrolyzing process disclosed in U.S. Pat. No. 3,773,634.

The cathode-structure of the invention, nevertheless, is most effective for the electrolysis of alkali metal salts, for example, halides, sulfates, nitrates, and phosphates of lithium, sodium, potassium, rubidium, and cesium. It can be used also for electrolysis of acids such as hydrochloric acid, sulfuric acid, nitric acid or phosphoric acid.

Generally, it is preferred to use fluorine-containing polymers having oxidation resistance as the polymer to be laminated on the cathode. When the electrode structure of this invention contains a cation exchange resin portion which is made of a material having resistance to oxidizing agents, such as fluroine-containing materials and inorganic materials, they may be used as a pair with an anode. When the cation exchange resin portion is made of a hydrocarbon-type material having no oxidation resistance, and an oxidizing substance is generated from the anode at the time of electrolysis, a neutral electrically conductive diaphragm may be disposed in order to prevent the oxidative degradation of the resin portion. Or a cation exchange membrane having oxidation resistance may be disposed for this purpose. Where an alkali metal salt is to be electrolyzed, the alkali metal salt may be filled in a space between the diaphragm and the electrode structure of this invention, or an alkali metal hydroxide solution may be filled in that space.

Accordingly, to this invention, there can be provided a cathode-structure in which the polymeric film is laminated intimately onto the cathode having a freely curved structure. By building an electrolytic cell using the cathode-structure of this invention, the membrane can be maintained stable, and the electrolytic cell can be operated at low cell voltages. It is also possible to prolong the lives of the membrane and the anode. Furthermore, by applying the electrode structure to a finger-type electrode, there can be built an electrolytic cell which has a higher output and gives purer sodium hydroxide than with electrolytic cells of the same volume.

The following Examples illustrate the present invention in greater detail. It should be understood that these Examples do not limit the invention in any way.

EXAMPLE 1

A plain weave fabric of polytetrafluoroethylene was interposed between two 5-mil thick films of a copolymer of tetrafluoroethylene and perfluoro(3,6-dioxa-4-methyl-7-octenesulfonyl fluoride) which has an ion exchange capacity corresponding to 0.91 meq/g of dry membrance ($H^+$ type, 1100 equivalent weight) in the hydrolyzed state, and by melt-adhesion under heat, made into a single film structure. Furthermore, a 1.5 mil thick film of the same copolymer having an ion exchange capacity corresponding to 0.67 meq/g of dry weight ($H^+$ type, 1500 equivalent weight) in the hydrolyzed state was superimposed on the resulting structure and melt-adhered to form a single polymeric membranous product.

One surface of a mild steel lath material was mechanically roughened, and a dispersion of polytetrafluoroethylene was coated on the roughened surface, followed by air drying and heating at 350° C. The coated mild steel material was dipped in an aqueous solution containing nickel rhodanide [$Ni(SCN)_2$] to plate the uncoated surface with nickel by electrolysis.

That side of the resulting polymeric membranous product which had a lower exchange capacity was pressed into the cathode by heating, whereby the mild steel lath electrode entered the polymeric membranous product. The assembly was immersed in an 8% methanol of potassium hydroxide solution at room temperature for 48 hours to convert the sulfonyl fluoride group to a potassium sulfonate group to form a cation exchange membrane and thus make the cathode-structure of this invention.

A two-compartment electrolytic cell was built by combining this structure with an anode composed of a titanium lath material coated with ruthenium dioxide and titanium dioxide. In this case, that side of the cathode-structure which was covered with the polymeric film was placed facing the anode, and the distance between the cathode and the anode was adjusted to 3 mm. A saturated aqueous solution of sodium chloride was fed into an anode compartment, and electrolyzed at a decomposition rate of 35%. Pure water was fed into the cathode so that 6.0N NaOH could be steadily obtained from the cathode compartment. The electrolysis temperature was maintained at 85° C, and the current density was 30 A/dm$^2$.

Separately, a woven fabric of polytetrafluoroethylene was interposed between two polymeric films, 5 mil thick and the same as those used hereinabove, having an ion exchange capacity of 0.91 meq/g of dry membrane ($H^+$ type), and melt-adhered under heat. A 1.5-mil thick polymeric film having an ion exchange capacity of 0.67 meq/g of dry membrane ($H^+$ type) was melt-adhered under heat to the resulting assembly to form a single polymeric membranous product. The resulting product was immersed in an 8% methanol solution of potassium hydroxide to hydrolyze it and obtain a potassium sulfonate acid-type cation exchange membrane. The resulting cation exchange membrane was disposed between the same mild steel lath material as used in producing the cathode structure, which was nickel-plated all over the surface in this case and the same anode as used above so that the side having a lower exchange capacity faced the cathode and made contact with it. Using the resulting cell, a saturated aqueous solution of sodium chloride was fed, and electrolyzed at a decomposition rate of 35%. The distance between the anode and the cathode was adjusted to 3 mm, and the current density and the electrolyzing temperature were adjusted to the same values as in electrolysis using the above-mentioned film-cathode structure. This electrolysis was continued for 3 months while maintaining the conditions as identical as possible.

In all cases, the effective area of current flowing was 1 dm$^2$.

The cell voltage, the current efficiency and sodium chloride concentration in the sodium hydroxide obtained were measured, and the results are shown in Table 1.

Table 1

| | | Current efficiency (%) | Amount (ppm) of NaCl in NaOH (calculated on 48% NaOH | Cell voltage (V) |
|---|---|---|---|---|
| When the cathode-structure of the invention was used | at the outset | 85 | 38 | 3.65 |
| | 3 months later | 84 | 40 | 3.70 |
| When the filter-press type cell was used | at the outset | 83 | 85 | 3.95 |
| | 3 months later | 80 | 110 | 4.15 |

EXAMPLE 2

A 0.3-mm thick polymeric film of the following structural formula

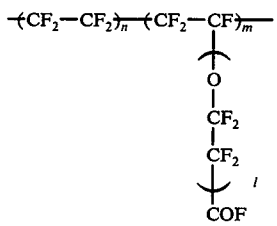

wherein $n$ and $m$ are positive integers (a mixture of $l=1$, 2 and 3) was laminated to a cathode to build a laminated cathode-structure in accordance with the present invention. The membrane was hydrolyzed to convert —COF to —COOH. The hydrolyzed product had an ion exchange capacity of 0.833 meq/g of dry membrane ($H^+$ type) (1200 equivalent weight). The cathode used was built by plating one surface of a mild steel lath material with nickel using a bath containing nickel rhodanide, coating the other side with a dispersion of a copolymer of tetrafluoroethylene and hexafluoropropylene (Neoflon Dispersion ND-1, a trademark for a product of Daikin Kogyo K.K.), air-drying the coating and then heat-treating it at 300° C. The carboxylic acid halide-type polymeric film was melt-adhered under heat to the copolymer-coated surface of the cathode to produce the cathode-structure of this invention. In this case, the polymeric film did not melt-adhere to the nickel-plated surface of the cathode, but melt-adhered to that surface which was coated with a copolymer of tetrafluoroethylene and hexafluoropropylene. Furthermore, a part of the electrode surface coated with the copolymer of tetrafluoroethylene and hexafluoropropylene remained uncovered with the carboxylic acid halide-type film after its melt-adhesion.

Using the resulting cathode-structure and an anode composed of a titanium lath material coated with ruthenium dioxide and titanium dioxide, a saturated aqueous solution of sodium chloride was electrolyzed. The distance between the anode and the cathode was adjusted to 3 mm, and the current density was 30 A/dm$^2$. The decomposition rate of the sodium chloride solution at the anode was 60%. Pure water was fed into the cathode compartment so that 8.2 N sodium hydroxide could be obtained steadily. During the electrolysis, the temperature within the cathode compartment was maintained at 90° C.

Separately, for comparison, a saturated aqueous solution of sodium chloride was electrolyzed using a filter press type electrolytic cell using a 0.3 mm thick cation exchange membrane of a carboxylic acid type tetrafluoroethylene/perfluoro carboxylic acid copolymer having the above-given chemical structure. In this case, the anode was the same as set forth above and produced by coating a titanium lath material with ruthenium dioxide and titanium dioxide. The cathode used was the same as that used for producing the cathode-structure which was produced by nickel-plating the entire surface of a mild steel lath material. The cation exchange membrane was brought into contact with the cathode by applying a pressure of 200 mm (water pressure) to the anode side. The electrolyzing temperature, the utilization ratio of an aqueous solution of sodium chloride, and the current density were quite the same as in the case of using the cathode-structure of the invention. In either case, the effective area of current flowing was adjusted to 3 dm$^2$ (50 × 600 mm). The electrolytic cell was constructed in a vertically elongated shape, and the effect of bubbles generated at the electrodes of the cell voltage was examined. The electrolysis was performed for about 3 months under the same conditions.

The cell voltage, the current efficiency and the sodium chloride concentration in the sodium hydroxide obtained were measured, and the results are shown in Table 2.

Table 2

| | | Current efficiency (%) | Amount (ppm) of NaCl in NaOH (Calculated on 48% NaOH) | Cell voltage (V) |
|---|---|---|---|---|
| When the cathode-structure of the invention was used | at the outset | 92 | 20 | 3.48 |
| | 3 months later | 92 | 20 | 3.52 |
| When the filter press type electrolytic cell was used | at the outset | 91 | 45 | 3.72 |
| | 3 months later | 90 | 50 | 3.88 |

EXAMPLE 3

Two 2-mil thick films of a copolymer of tetrafluoroethylene and perfluoro(3,6-dioxa-4-methyl-7-octenesulfonyl fluoride) having an ion exchange capacity corresponding to 0.91 meq/g of dry membrane ($H^+$ type, 1100 equivalent weight) in the hydrolyzed state were melt-adhered under heat to form a single polymeric film structure. A 2-mil thick film of the same copolymer having an ion exchange capacity corresponding to 0.67 meq/g of dry membrane ($H^+$ type, 1500 equivalent weight) in the hydrolyzed state was superimposed on it and melt adhered thereto to form a single polymeric membraneous product.

The outside surface of a finger-type mesh cathode of mild steel was roughened and the roughened surface was coated with an emulsion of polyvinylidene fluoride, air dried, and heated at 250° C to coat the polyvinylidene fluoride on one surface only. The opposite back surface was nickel-plated by electrolysis using a nickel rhodanide bath. That surface of the polymeric membraneous product obtained above which had a lower exchange capacity was melt-adhered by heating to the surface coated with polyvinylidene fluoride to produce the cathode-structure of this invention. The structure was then dipped in a mixed solution composed of 10 parts of ethylenediamine and 10 parts of water at 50° C for 1.0 hour, and then heated at 180° C for 1 hour to bond ethylene diamine to the membranous product by an acid amide linkage. Simultaneously, a crosslinkage was formed partially in the membranous product. The product was dipped in and 8% methanol solution of a potassium hydroxide at room temperature for 24 hours to convert the remaining sulfonyl fluoride group to a potassium sulfonate group. Using the resulting cathode-structure as a pair woith a finger-type anode made by coating a titanium lath material with ruthenium dioxide and titanium dioxide with the distance between them being adjusted to 3mm, a saturated aqueous solution of sodium chloride was fed into the anode compartment, and electrolyzed at a decomposition ratio of 45%. Pure water was fed into the cathode compartment so that 7.0 N sodium hydroxide could be steadily obtained.

For comparison, an anode produced by applying a coating of the same noble metal oxide mixture as used above to the entire surface of a titanium lath material of the same shape, and a cathode made by nickel-plating the entire surface of the same mild steel mesh as used above were employed. The distance between them was adjusted to 3 mm, and a cation exchange membrane of the perfluorosulfonic acid type wtreated by ethylenediamine under the same conditions was disposed between them so that it was urged against the cathode surface by applying a water pressure. Electrolysis was carried out under the same conditions as in the case of using the above-mentioned cathode-structure. The cation exchange membrane used in this case was the same as that used in the example of this invention given immediately preceding this paragraph. That side of the cation exchange membrane which faced the cathode had a lower exchange capacity.

The current density was about 30 A/dm$^2$, and the actual effective area of the membrane was 5 dm$^2$ in either case. The temperature within the electrolytic cell was about 90° C.

In the comparison run where the cathode and the membrane did not form a unitary structure, the membrane contacted the cathode, and a part of it also made contact with the anode during the electrolysis. Furthermore, it swelled during electrolysis, and gases generated stayed between the electrodes and the membranes.

The cell voltage, the current efficiency and the sodium chloride concentration were measured, and the results are shown in Table 3.

Table 3

| | | Current efficiency (%) | Amount (ppm) of NaCl in NaOH (calculated on 48% NaOH) | Cell voltage (V) |
|---|---|---|---|---|
| When the laminated cathode structure of the invention was used | at the outset | 94 | 35 | 3.60 |
| | 3 months later | 94 | 35 | 3.68 |
| when the cathode and the membrane were used in the separated state | at the outset | 94 | 80 | 4.21 |
| | 3 months later | 93 | 85 | 5.01 |

Table 3-continued

EXAMPLE 4

Using the same finger-type cathode-structure as produced in Example 3 in pair with the same finger-type anode resulting from the coating of a titanium lath material with $RuO_2$ and $TiO_2$ as used in Example 3, electrolysis was carried out at a current density of 30 A/dm$^2$ so that the average concentration of sodium chloride solution within the anode compartment was 1.0 N. Pure water was not fed into the cathode compartment.

As a result, a 34% solution of sodium hydroxide could be recovered from the cathode compartment at a current efficiency of 92%. The cell voltage was 3.75V.

For comparison, electrolysis was carried out under the same conditions using a cation exchange membrane of the perfluoro-sulfonic acid type treated with ethylene diamine disposed between the finger-type anode and the same finger-type cathode shown above. As a result, a 34% solution of sodium hydroxide was obtained at a current efficiency of 90%. The cell voltage was 4.82V. The cell voltage tended to increase with time.

EXAMPLE 5

A styrene/butadiene rubber was uniformly dissolved in 20 part of methyl methacrylate, 20 parts of styrene, 10 parts of divinylbenzene (purity 55%) and 20 parts of stearyl methacrylate, and 1%, based on the entire monomers, of benzoyl peroxide was added to form a viscous paste mixture. The mixture was uniformly coated on a Vinylon (polyvinyl alcohol) woven cloth one surface of which was covered with Cellophane.

Then, the woven cloth was capped on a finger-type mesh cathode with the Cellophane-free surface placed inwardly so that it conformed to the shape of the cathode. The assembly was heated at 80° C for 24 hours to form a polymeric film adhered firmly to the curved surface of the cathode. The assembly was then dipped in a 4N aqueous solution of sodium hydroxide for 24 hours to produce a cathode structure in which the cation exchange membrane was laminated.

The ion exchange membrane obtained above was found to have an electric resistance of 12 ohms-ch$^2$ in a 0.5 N aqueous solution of sodium hydroxide at 25° C.

Using this cathode structure, sodium chloride was electrolyzed in a three-compartment electrolytic cell. The current efficiency to obtain a 6.0 N sodium hydroxide was as good as 94%. The sodium chloride concentration, calculated on 48% NaOH, in the resulting caustic was as low as 70 ppm.

EXAMPLE 6

A monomeric mixture consisting of 28 parts of methyl vinyl ketone, 14 parts of styrene and 3 parts of divinylbenzene (purity 50%) was heated with stirring at 65° C for 1 hour in the presence of azoisobutyronitrile as a polymerization catalyst to form a viscous polymer. The polymer was coated uniformly on a cathode having a complex curved surface. The shape of the coated polymer was adjusted by covering a framework of polypropylene fabricated in a shape symmetrical to the cathode in a little bit larger size.

The assembly was heated at 70° C for 6 hours to advance the polymerization reaction to form a polymeric membrane integrated with the cathode. The resulting structure was dipped in a mixture (1:2) of phosphorus trichloride and dioxane in a moisture-free condition at room temperature for about 40 hours. Furthermore, the structure was dipped in glacial acetic acid at room temperature for 20 hours, and then washed thoroughly with water.

The resulting ion exchange membrane was found to have an electric resistance of 5 ohms-cm$^2$ in a 0.5N aqueous solution of sodium chloride, and superior alkali resistance.

EXAMPLE 7

20 parts of sodium m-phenolsulfonate, 18 parts of phenol and 6 parts of formaldehyde were heated at 100° C for 50 minutes in the presence of sodium hydroxide as a catalyst to form a red brown viscous precondensate. The product obtained was coated on a Vinylon woven cloth, and then bonded to a finger-type cathode. The assembly was heated at 75° C for 30 minutes to condense the precondensate.

The resulting polymeric membrane had an electric resistance of 4 ohms-cm$^2$ and an exchange capacity of 1.6 meq/g of dry membrane.

EXAMPLE 8

A Teflon sheet was bonded to one outside surface of a finger-type nickel mesh used for conventional sodium chloride electrolysis, and a 0.3 mm thick sheet of a thermoplastic polymer of the following structural formula was melt-adhered to the other surface.

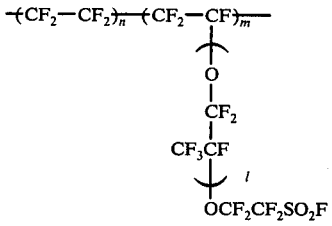

The Teflon sheet was removed, and the assembly was dipped in a 5.0N aqueous solution of potassium hydroxide at 80° C for 24 hours to convert a sulfonyl fluoride group to a potassium sulfonate group. It was then dipped in nitric acid to convert the polymer to the hydrogen ion type, and further dipped in sodium hydroxide to convert it to the sodium type. When this sheet was melt-adhered to one surface of the cathode mesh, it entered the interstices of the mesh. That part of the sheet which extended to the other surface of the mesh was shaved off to expose the electrode. Freedom from water leakage was ascertained by applying a water pressure of 10 m (water column) from outside the mesh. Using this cathode-structure as a pair with an insoluble anode made by coating a titanium mesh with titanium oxide and ruthenium oxide, an aqueous solution of sodium chloride was electrolyzed at a current density of 20A/dm$^2$. A 6.0N aqueous solution of sodium hydroxide was steadily obtained from the cathode. At this time, the interelectrode voltage was 3.85V at 60° C. The current efficiency for the formation of sodium hydroxide was 65%. The amount of sodium chloride in the 50% sodium hydroxide was 660 ppm.

EXAMPLE 9

The cathode structure made in Example 8 in which the perfluoro polymer was of the sulfonyl fluoride type was dipped in each of the baths shown in Table 4 for the periods indicated and the residual sulfonyl fluoride was hydrolyzed out by a usual method. Using each of the resulting structures, the same sodium chloride electrolysis as in Example 8 was performed at a temperature of 60° C. The results are shown in Table 4.

Table 4

| Reaction bath | Dipping periods (hours) | Concentration of NaOH obtained (N) | Current efficiency (%) | NaCl in NaOH (ppm, calculated on 50% NaOH) | Voltage between the electrodes (V) |
|---|---|---|---|---|---|
| Diisopropylamine | 2.0 | 6.0 | 94 | 250 | 4.02 |
| Diethyl amine | 1.0 | 5.9 | 94 | 260 | 4.10 |
| Tetraethylene pentamine: water=10:1 (weight ratio) | 24.0 | 6.2 | 95 | 230 | 4.12 |
| Piperazine | 1.5 | 5.8 | 93 | 300 | 4.00 |
| Propylamine: water=5 : 1 (weight ratio) | 3.0 | 5.7 | 88 | 420 | 3.98 |

EXAMPLE 10

A linear polymer having a molecular weight of about 300,000 was obtained by solution polymerization of p-hydroxystyrene in a customary manner. The polymer was dissolved in an aqueous solution of sodium hydroxide, and paraformaldehye and iminodiacetic acid were added. The mixture was heated to bond the iminodiacetic acid to the poly(p-hydroxystyrene) and thus to form an amphoteric polyelectrolyte containing a carboxylic acid and a tertiary amine. The polyelectrolyte and polyvinyl alcohol in a weight ratio of 2 : 1 were dissolved in an aqueous solution of an alkali to form a viscous aqueous solution of the polymers. A structure made by bonding a Teflon sheet to the inside surface of a cylindrical stainless steel wire gauze (200 mesh) with a diameter of 10 cm was dipped in the polymeric solution. It was withdrawn, air-dried, and then dipped in a bath consisting of a mixed solution of Glauber'salt, sulfuric acid and formaldehyde at 60° C for 1 hour, and the Teflon sheet was removed. Using this cathode-structure and a cylindrical graphite as an anode placed in a concentric relation, an aqueous solution of potassium chloride was electrolyzed on a small scale. Potassium hydroxide was obtained in a concentration of 6.0N from the cathode side, and the current efficiency was 96%. The amount of potassium chloride in the potassium hydroxide was about 250 ppm calculated on 50% KOH.

EXAMPLE 11

The cathode-structure of this invention produced in Example 1 was dipped at 70° C for 2 hours in a 1% aqueous solution of polyethylene oxide having a molecular weight of about 1,500, and washed with water. Using the treated cathode-structure in pair with the same anode as used in Example 1, an aqueous solution of sodium chloride was electrolyzed under the same conditions as in Example 1. 6.0N sodium hydroxide was obtained steadily from the cathode. The current efficiency was 95%, and the cell voltage was 3.75V.

Separately, without using the cathode-structure of this invention, the same electrolysis was performed in an ordinary clamped-type electrolytic cell using the same perflurosulfonic acid-type membrane treated with polyethylene oxide. 6.0 N sodium hydroxide was obtained. The current efficiency was 93%, and the cell voltage was 3.90 V.

What we claim is:

1. A cathode-structure for liquid-phase electrolysis of an aqueous solution of an alkali metal salt comprising a perforated cathode and a polymer containing cation exchange groups in its molecule, said cathode being electrochemically inactivated on one surface, thereof said polymer being laminated in the form of a film on said electrochemically inactivated surface of said cathode.

2. The cathode-structure of claim 1 wherein said polymer is a fluorine-containing ion exchange resin.

3. The cathode-structure of claim 1 wherein the surface of the cathode is curved.

4. The cathode-structure of claim 1 wherein the cathode is a finger-type electrode.

5. The cathode-structure of claim 1 wherein the polymer is laminated on the electrochemically inactivated surface of the cathode by melt-adhesion of the polymer.

6. The cathode-structure of claim 1 wherein the polymer is laminated by directly forming a film of the polymer on said electrochemically inactivated surface of the cathode.

7. An electrolytic cell equipped with the cathode-structure of claim 1.

8. A process for electrolysis of an aqueous solution of an alkali metal salt using the cathode structure of claim 1.

9. The cathode structure of claim 1 wherein said electrochemically inactivated surface of the cathode is formed by coating said one surface of the cathode with a resin or paint.

* * * * *